US006942412B2

(12) United States Patent
Gueret

(10) Patent No.: US 6,942,412 B2
(45) Date of Patent: Sep. 13, 2005

(54) PRODUCT APPLICATION DEVICE INCLUDING A DIP TUBE

(75) Inventor: Jean-Louis H. Gueret, Paris (FR)

(73) Assignee: L'Oréal, Paris (FR)

( * ) Notice: Subject to any disclaimer, the term of this patent is extended or adjusted under 35 U.S.C. 154(b) by 126 days.

(21) Appl. No.: 09/986,021

(22) Filed: Nov. 7, 2001

(65) Prior Publication Data

US 2002/0094225 A1 Jul. 18, 2002

(30) Foreign Application Priority Data

Nov. 7, 2000 (FR) ..... 00 14289

(51) Int. Cl.[7] ..... B43M 11/06

(52) U.S. Cl. ..... 401/183; 401/123; 401/124; 401/127; 401/130; 401/262

(58) Field of Search ..... 401/123, 124, 401/125, 127, 126, 130, 183, 186, 262, 263, 261; 222/205

(56) References Cited

U.S. PATENT DOCUMENTS

| | | | |
|---|---|---|---|
| 813,813 | A | 2/1906 | Munroe |
| 1,534,259 | A | 4/1925 | Dempsey |
| 1,573,036 | A | 2/1926 | Bowman |
| 1,580,690 | A | 4/1926 | Sierad et al. |

(Continued)

FOREIGN PATENT DOCUMENTS

| | | |
|---|---|---|
| CA | 1 288 391 | 9/1991 |
| CH | 339 231 | 6/1959 |
| CH | 406 544 | 8/1966 |
| CH | 406 544 | 1/1996 |

(Continued)

OTHER PUBLICATIONS

English language translation of DE 406,544, Aug. 15, 1966.
English language Derwent Abstract of EP 1 029 799, Aug. 23, 2000.
Co–pending Application No. 09/482,685; Title: Device for Dispensing and Applying a Product, Inventor(s): Jean–Louis H. Gueret, U.S. Filing Date: Jan. 14, 2000.
Co–pending Application No. 09/550,588; Title: Applicator and Applicator Assembly Equipped with such an Applicator, Inventor(s): Jean–Louis H. Guerett, U.S. Filing Date: Apr. 17, 2000.
Co–pending Application No. 09/981,184, Title: Application Device, System, and Method, Inventor: Jean–Louis H. Gueret, U.S. Filing Date: Oct. 18, 2001.
English language Derwent Abstract of DE 39 38 347, May 23, 1991.
English language Derwent Abstract of EP 0 743 263, Nov. 20, 1996.
English language Derwent Abstract of EP 1 020 135, Jul. 19, 2000.
English language Derwent Abstract of EP 1 044 625, Oct. 18, 2000.

(Continued)

*Primary Examiner*—Timothy L. Maust
(74) *Attorney, Agent, or Firm*—Finnegan Henderson Farabow Garrett & Dunner, L.L.P.

(57) ABSTRACT

A product application device includes a receptacle having a variable inside volume configured to contain a product, an applicator element, and a dip tube configured to extend to the bottom of the receptacle. The device further includes a first portion and a second portion configured to cooperate together to define a substantially leak-proof enclosure for the applicator element. The dip tube is configured to enable the enclosure to be in flow communication with the product flowing from the receptacle.

107 Claims, 8 Drawing Sheets

U.S. PATENT DOCUMENTS

| | | | | | |
|---|---|---|---|---|---|
| 2,311,367 | A | | 2/1943 | Chambers | |
| 2,554,302 | A | | 5/1951 | Keskitalo | |
| 2,554,489 | A | | 5/1951 | Crane | |
| 2,716,250 | A | * | 8/1955 | Deakers | 401/186 |
| 2,767,417 | A | * | 10/1956 | Amen | 401/125 X |
| 2,807,816 | A | | 10/1957 | O'Brien | |
| 3,209,769 | A | | 10/1965 | Gobin | |
| 3,266,079 | A | | 8/1966 | Schwartzman | |
| 3,345,673 | A | | 10/1967 | Schwartzman | |
| 3,390,940 | A | * | 7/1968 | Schwartzman | 401/186 |
| 3,540,448 | A | | 11/1970 | Sunnen | |
| 3,862,806 | A | | 1/1975 | Brown | |
| 3,871,390 | A | | 3/1975 | Spatz | |
| 4,089,609 | A | | 5/1978 | Gring et al. | |
| 4,752,147 | A | | 6/1988 | Persi | |
| 4,795,063 | A | | 1/1989 | Sekiguchi et al. | |
| 5,002,415 | A | | 3/1991 | Gueret | |
| 5,052,592 | A | | 10/1991 | Wilken et al. | |
| 5,088,849 | A | | 2/1992 | Johnson et al. | |
| 5,096,319 | A | | 3/1992 | Gueret | |
| 5,178,300 | A | | 1/1993 | Haviv et al. | |
| 5,188,472 | A | | 2/1993 | Sgro | |
| 5,324,127 | A | | 6/1994 | Cortez | |
| 5,492,426 | A | | 2/1996 | Gueret | |
| 5,636,931 | A | | 6/1997 | Gueret | |
| 5,692,846 | A | | 12/1997 | Schwarzberg | |
| 5,865,194 | A | | 2/1999 | Gueret | |
| 5,890,828 | A | | 4/1999 | Gueret | |
| 5,945,076 | A | | 8/1999 | Leonard et al. | |
| 6,309,124 | B1 | | 10/2001 | Gueret | |
| 6,447,191 | B1 | * | 9/2002 | Vasas | 401/127 X |

FOREIGN PATENT DOCUMENTS

| | | |
|---|---|---|
| DE | 938 658 | 1/1956 |
| DE | 406 544 | 8/1966 |
| DE | 2 157 620 | 5/1973 |
| DE | 39 38 347 | 5/1991 |
| EP | 0 263 329 | 4/1988 |
| EP | 0 688 516 | 1/1990 |
| EP | 0 374 339 | 6/1990 |
| EP | 0 380 183 | 8/1990 |
| EP | 0 743 263 | 11/1996 |
| EP | 0 612 488 | 5/1997 |
| EP | 1 020 135 | 7/2000 |
| EP | 1 029 799 | 8/2000 |
| EP | 1 044 625 | 10/2000 |
| FR | 1 461 630 | 2/1967 |
| FR | 2 502 472 | 10/1982 |
| FR | 2 588 457 | 4/1987 |
| FR | 2 633 498 | 1/1990 |
| FR | 2 744 602 | 8/1997 |
| FR | 2 750 406 | 1/1998 |
| FR | 2 754 458 | 4/1998 |
| FR | 2 792 296 | 10/2000 |
| GB | 838 800 | 6/1960 |
| GB | 1 105 590 | 3/1968 |
| GB | 1158412 | 7/1969 |
| GB | 1 311 086 | 3/1973 |
| GB | 2 084 455 | 4/1982 |
| GB | 2 137 181 | 10/1984 |
| JP | 40-1103 | 1/1965 |
| JP | 44-14946 | 6/1969 |
| JP | 60-157674 | 10/1985 |
| JP | 2-138620 | 11/1990 |
| JP | 4-23688 | 2/1992 |
| JP | 3051963 | 6/1998 |
| WO | WO 91/12197 | 8/1991 |
| WO | WO 99/38561 | 8/1999 |

OTHER PUBLICATIONS

English language Derwent Abstract of FR 2 502 472, Oct. 1, 1982.

English language Derwent Abstract of FR 2 750 406, Jan. 2, 1998.

English language Derwent Abstract of FR 2 792 296, Oct. 20, 2000.

English language translation of CH 406 544.

English language translation of FR 2 588 457.

English language translation of German Patent No. 938 658, Jan. 5, 1956.

English language translation of French Patent No. 1,461, 630.

Office communication dated Feb. 6, 2003, from U.S. Patent and Trademark Office in Co–pending Application No. 09/981,184.

Response of Office communication of Feb. 6, 2003, filed in USPTO Mar. 3, 2003, in Co–pending Application No. 09/981,184.

Office communication dated May 22, 2003 from U.S. Patent and Trademark Office in Co–pending Application No. 09/981,184.

Response to Office communication of May 22, 2003, filed on Sep. 30, 2003, in Co–pending Application No. 09/981,184.

* cited by examiner

PRODUCT APPLICATION DEVICE INCLUDING A DIP TUBE

The present invention relates to a device for packaging and applying a product, for example, a care product or a cosmetic product such as a perfume. The device may comprise a receptacle configured to contain the product, an applicator element, and a dip tube to allow product to flow from the receptacle to charge the applicator element.

DESCRIPTION OF THE RELATED ART

There exists a need for a packaging and applicator device having a structure that is relatively simple, and that enables an applicator element to be filled easily with a relatively large quantity of product. There also exists a need for a device that is capable of containing a product that may have a low viscosity, such as, for example, a perfume, while limiting the risk of leakage in the event of the device being tipped over accidentally.

SUMMARY

Optionally, the present invention satisfies one or more needs and/or overcomes one or more shortcomings.

According to an exemplary aspect of the invention, a device may comprise at least one receptacle having a variable inside volume being configured to contain a product. A dip tube may be provided in the receptacle. At least one enclosure may be provided that is suitable for taking up a substantially closed configuration and suitable, when in the substantially closed configuration, for containing an applicator element. The enclosure may also be suitable, when in the substantially closed configuration, for being put into fluid communication with the receptacle via the dip tube.

The terms "substantially closed" and "substantially leak-proof" as used herein are intended to define a state of the device whereby a product seal is provided by the portion(s) of the device in the "substantially closed" or "substantially leak-proof" state. For example, when the product is a liquid, this seal could be a liquid tight seal. This product seal is intended to exist when the device is used in a manner consistent with the disclosure contained herein so as not to allow product to flow out of sealed portion(s) of the device. Optionally, this "substantially closed" and "substantially leak-proof" state may also at least inhibit the free flow of gas out of the device and/or provide an airtight arrangement whereby air does not normally enter through this "seal" at all.

Exemplary embodiments of the invention may be configured to enable the applicator element to be filled while the enclosure containing it is substantially closed. As a result, product flowing into the enclosure might tend to generate a pressure rise opposing further ingress of the product. This might make it possible to prevent product penetrating into the enclosure too quickly or in too great a quantity, which could, for example, lead to an applicator element being soaked excessively with product. Furthermore, it might be easier to control the amount of product that is taken up from the receptacle, for example.

According to another optional aspect of the invention, the device can comprise at least one receptacle of variable inside volume configured to contain a product. The device may have at least one housing for receiving an applicator element and also at least one closure element for substantially closing the housing. The device may further comprise at least one applicator element suitable for being contained in the housing when the closure element is in place to substantially close said housing, and a dip tube enabling the housing to be fed.

According to another optional aspect of the invention, the device may comprise at least one receptacle having variable inside volume including a dip tube and being configured to contain a product. Further, the device may include at least one removable unit suitable for housing an applicator element and suitable for being put into fluid communication with the receptacle, wherein the product is delivered to the removable unit via the dip tube. Additionally, the applicator element may be suitable for being contained in a substantially closed space inside the removable unit when the removable unit is in fluid communication with the receptacle.

In an exemplary embodiment of the invention, the receptacle may be suitable for responding to actuation by passing from a first configuration in which the receptacle presents a first inside volume to a second configuration in which the receptacle presents a second inside volume smaller than the first, the transition from the first configuration to the second generating pressure inside the receptacle suitable for forcing the product to rise into the housing via the dip tube.

In other words, according to this optional aspect, the housing may be fed directly with product by the dip tube, and without an intermediate pump. Thus, when the receptacle has a wall that is compressible, squeezing the receptacle may cause the product to rise into the housing and feed the applicator element with product. Thus, there may be no need to turn the receptacle upside-down in order to fill the applicator element with product, and the receptacle may be used in an upright position while filling the applicator element with product.

In an optional aspect, the device may comprise a receptacle having a variable inside volume configured to contain product, an applicator element and a housing for receiving at least part of the applicator element. The device may also include a closure element configured to close the housing in a substantially leak-proof manner when the applicator element is received at least partially in the housing and also a dip tube configured to extend substantially to the bottom of the receptacle. The dip tube may be configured to enable the housing to be in flow communication with product flowing from the receptacle.

According to another optional aspect, the device may be configured to allow a reduction in the variable inside volume of the receptacle from a first volume to a second volume smaller than the first volume. This reduction from the first volume to the second volume may generate pressure inside the receptacle for causing product to flow into the housing via the dip tube.

In an optional aspect, the product application device may comprise a receptacle having a variable inside volume configured to contain product, an applicator element, and a dip tube configured to extend to the bottom of the receptacle. The device may further comprise a first portion and a second portion configured to cooperate together to define a substantially leak-proof enclosure for the applicator element. Optionally, at least one of the first portion and a second portion may comprise a sealing skirt. The dip tube may also be configured to enable the enclosure to be in flow communication with product flowing from the receptacle.

In one aspect, the first portion may comprise a housing for receiving at least part of the application element, and the second portion may comprise a closure element configured to close the housing. At least one of the closure element and the housing may define a removable unit configured to be associated with the receptacle to fill the unit with the product, and an applicator element may be received within the removable unit. The housing may define a body and the closure element may define a handle. The body and the handle may cooperate to define an inside space in which the applicator element may be contained.

According to another optional aspect, the first and second portions may cooperate to define a removable unit. The device may also comprise a third portion located on the receptacle, wherein the removable unit may be configured to be removably associated with (e.g., received by) the third portion. In addition, the dip tube may be connected to the third portion.

In an optional aspect, the device may further comprise a closure element for closing the third portion when the removable unit is not associated with (e.g., not received by) the third portion. This third portion may be configured to be in flow communication with the variable inside volume via the dip tube. The third portion may optionally comprise a sleeve having an open end through which at least a part of the removable unit passes and another end placed in flow communication with the variable inside volume via the dip tube. In an alternative aspect, the third portion may comprise a protrusion for mating with a mating opening located at an end of the removable unit.

The structure of the device of the invention may be relatively simple, thus making it possible to ensure substantial reliability in operation while maintaining a cost price that is relatively low. The invention also may make it possible to limit the risk of product leaking out in the event of the device being accidentally turned upside-down because the dip tube may slow down or even completely prevent flow of product to the outside of the device.

In another optional aspect, the level to which the receptacle is filled with product may be selected in such a manner that prior to first use the end of the dip tube that opens out into the bottom of the receptacle lies above the level of the product when the receptacle is turned upside-down. Thus, if the receptacle is turned upside-down, the product may not flow out, thus reducing the risks of leaks.

In another optional aspect of the invention, the dip tube may open out into the bottom of the housing receiving the applicator element. The wall defining the end of the housing may be substantially planar or may also be concave towards the applicator element, thus making it possible to drain any excess product back towards the dip tube.

In an optional aspect of the invention, the dip tube may be a separate attachment that may be fixed on an end-piece formed integrally with an end wall of the housing. In a variant aspect, the dip tube may be formed integrally with the end wall of the housing.

The applicator element may also be removable, or in a variant it may be permanently fixed within the housing. If the applicator element is removable, it may form part of an applicator that also includes a handle. In an optional aspect of the invention, the applicator element may be removable and suitable for bearing against the end wall of the housing when the applicator is in place on the receptacle.

In another variant aspect, the applicator element and the end wall of the housing may be shaped so as to define a gap therebetween when the applicator element is in place on the receptacle. In this aspect, product may accumulate in the gap. The applicator element may thus present a recess in at least a portion of its surface that faces towards the end wall of the housing and product may accumulate in the recess, at least when the housing is fed with product. The end wall of the housing may also present a recessed portion going away from the applicator element.

In another variant, the end wall of the housing may present an annular rim against which at least a portion of the applicator element may come in to contact. The housing may also have an intermediate wall situated between the applicator element and the product inlet into the housing.

The housing may also include a pad made of porous material such as, for example, a foam material placed on the end wall of the housing and against which the applicator element may rest.

In another optional aspect, the applicator element may be removable and form part of an applicator that also includes a handle. The applicator element may thus be received in a removable unit suitable for being fixed temporarily on the receptacle in order to be filled with product. The removable unit may also be compact and easily carried, for example in a handbag, during the day.

In another optional aspect, the removable unit may comprises a body suitable for co-operating with the handle of the applicator in such a manner as to form an inside space in which the applicator element is contained, the space preferably being substantially leak-proof with respect to the product.

The handle and the body of the removable unit may co-operate (e.g., be connected), for example, by screw fastening. In addition, at least one of the handle and the body of the removable unit may include a sealing skirt.

By way of example, the removable unit may include a check valve enabling product to flow under pressure from the receptacle into the inside of the removable unit.

In an optional aspect, the device of the invention may include a closure member for closing the housing of the receptacle when not in use. When the receptacle housing receives a removable unit as explained above, the closure member may be brought into its closed position after the removable unit has been removed. This closure member may constitute a hinge lid, for example.

According to another optional aspect, the applicator element may be compressible. The applicator element may comprise a foam of a plastic material such as polyurethane, polyester, polyether, polyvinyl chloride (PVC), or nitrile butyl rubber (NBR), although this list is not intended to be limiting. The applicator element may also comprise, for example, a sintered element made at least partially of, for example, polyethylene, PVC, ethylene vinyl acetate (EVA), polyamide, or brass.

The applicator element may also comprise a felt material.

In an optional aspect, the receptacle may have a flexible wall. The receptacle may optionally include a bellows. With the inclusion of a bellows, the dip tube may be secured to a portion of the receptacle situated above the bellows, so as to move downwards with said portion when the bellows is compressed and reach the bottom of the receptacle, or come close enough thereto to enable it to dispense product.

The product may also be contained in a flexible bag forming a receptacle, whereby the bag may be contained in a case in which it is possible to generate pressure that is higher than the pressure that exists inside the bag. The case may also comprise a check valve for allowing gas to pass into the case as product is removed from the bag.

In another optional aspect, the device may be part of a product application system. The application system may include at least one additional receptacle comprising a variable inside volume configured to contain product and a dip tube configured to extend to the bottom of the additional receptacle. The dip tube of the at least one additional receptacle may be configured to enable the enclosure to be in flow communication with product flowing from the at least one additional receptacle. In addition, the system may comprise product in the receptacles, wherein each of the receptacles contains a differing product.

As mentioned above, the invention may be suitable for applying a perfume, which can be applied precisely and in a manner that may give rise to a great feeling of freshness.

BRIEF DESCRIPTION OF THE DRAWINGS

The accompanying drawings are included to provide a further understanding of the invention and are incorporated in and constitute a part of this specification. The drawings illustrate exemplary embodiments of the invention and, together with the description, serve to explain certain principles. In the drawings.

DETAILED DESCRIPTION

Figure 1A:
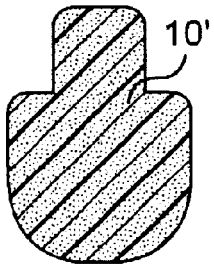
FIG. 1A is a cross-sectional view of an embodiment of an applicator formed of form material.

Reference will now be made in detail to exemplary embodiments of the invention, examples of which are illustrated in the accompanying drawings. Wherever possible, the same reference numbers are used in the drawings and the description to refer to the same or like parts.

Figure 1:
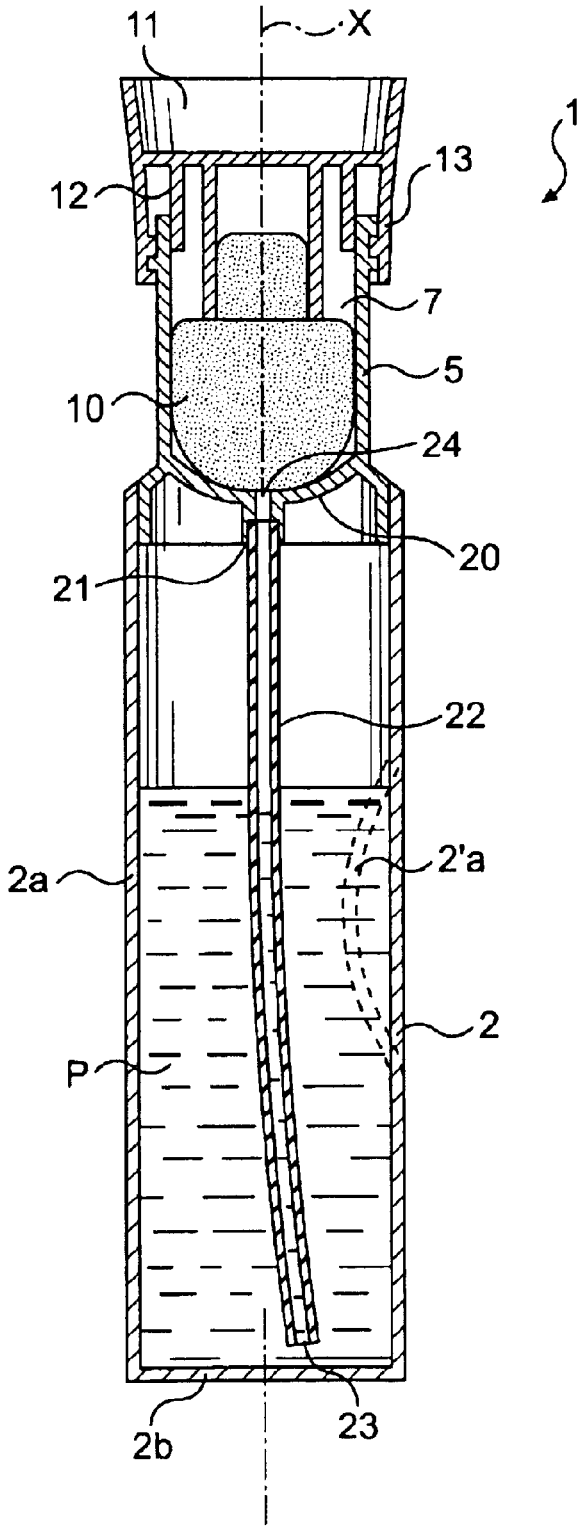
FIG. 1 is a cross section view of a device according to a first exemplary embodiment.

FIG. 1 shows a packaging and applicator device 1 of the invention, comprising a receptacle 2 having a tubular wall 2*a* about an axis X and a bottom end wall 2*b*. The tubular wall 2*a* may be made of flexible material so as to be elastically deformable. It is thus possible to reduce the inside volume of the receptacle 2 by squeezing the tubular wall, e.g. between finger and thumb, as shown schematically at 2*a'*.

The receptacle 2 may contain a product P, e.g. a liquid having very low viscosity such as a perfume. The top of the receptacle 2 has a neck 5 defining a housing 7 for receiving an applicator element 10. The applicator element 10 is secured to a handle 11 that also constitutes a cap for substantially closing the neck 5. In an exemplary embodiment, the applicator element 10' comprises a foam material, as shown in FIG. 1A.

The handle 11 (e.g., closure element, second portion, etc.) has a sealing skirt 12 suitable for bearing in substantially leak-proof manner against the inside surface of the neck 5 (e.g., first portion), thereby closing the housing 7 in a substantially leak-proof manner when the applicator element 10 is received at least partially in the housing 7. The handle 11 also has an outer skirt 13 provided with a thread suitable for screwing onto a complementary thread formed on the outside surface of the neck 5.

The neck 5 has a bottom end wall 20 provided on its underside with an end-piece 21 for fixing a dip tube 22. The end-piece 21 opens out into the housing 7 via an orifice 24. The dip tube 22 extends from the end-piece 21 to the end wall 2*b* of the receptacle 2.

In the example of FIG. 1, a substantial portion of the bottom surface of the applicator element 10 comes in contact with the end wall 20. To use the device 1 with the receptacle in a head-up position, the user may squeeze the tubular wall, as shown at 2*a'*, so as to reduce the variable inside volume of the receptacle 2 from a first volume to a second volume smaller than the first volume, wherein the reduction from the first volume to the second volume generates pressure inside the receptacle for causing product P to penetrate (e.g., flow) into the housing 7 via the dip tube 22.

The product P flowing along the dip tube 22 may come into contact with the applicator element 10, which becomes filled with product P, at least in the vicinity of the orifice 24. Thereafter, the user may withdraw the handle 11 and may bring the applicator element 10 into contact with a desired surface, such as, for example, regions to be perfumed.

In the event of the receptacle 2 being turned upside-down accidentally, the end 23 of the dip tube 22 may emerge above the product P, so that product does not flow into the housing 7.

Figure 2:
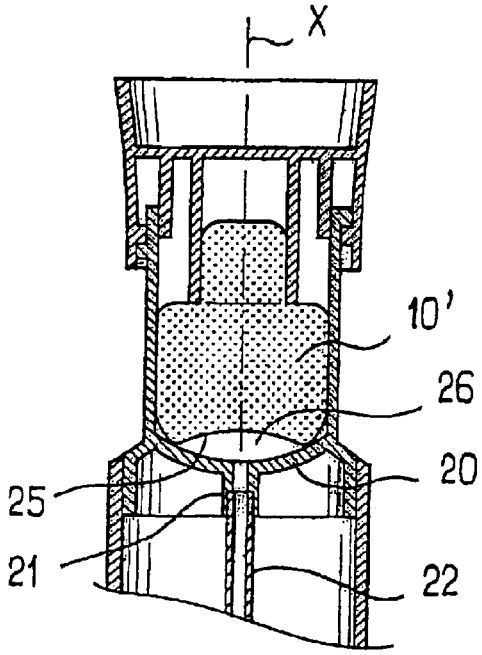
FIGS. 2 to 6 show cross section views of alternate top portions for the FIG. 1 device.

FIG. 2 shows a device which differs from that described above only in the shape of the applicator element 10'. This applicator element has a concave recess 25 in its surface that faces the end wall 20. The recess may cooperate with the end wall to define a gap 26 in which the product P may accumulate. The applicator element 10' may thus be easier to fill with product.

Figure 3:
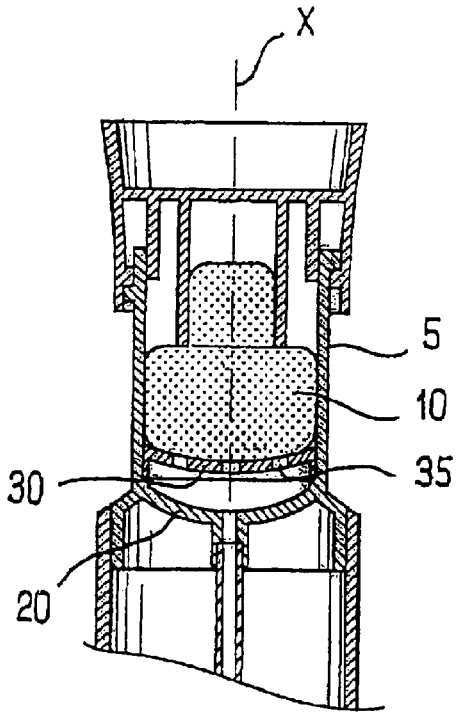

To improve the way in which product is distributed over the applicator element, it is possible to place an intermediate wall, or grid, 30 that is pierced by a plurality of orifices 35 inside the housing in the manner shown in FIG. 3.

Figure 4:
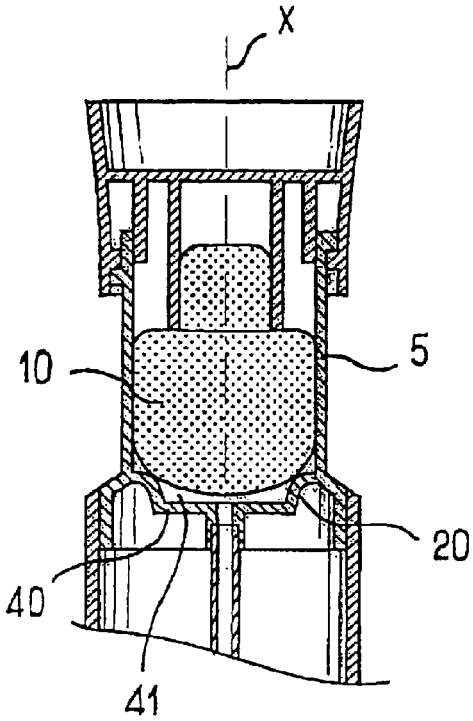
Figure 5:
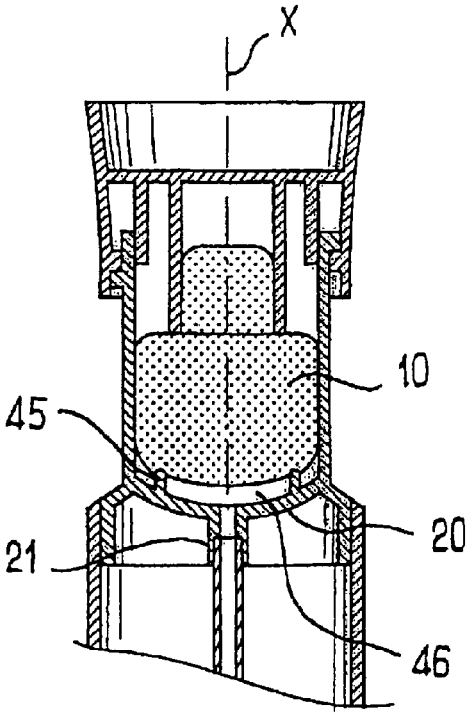

In another variant, shown in FIG. 4, the end wall 20 has a downwardly-directed recessed portion 40 leaving an empty gap 41 relative to the applicator element 10. In yet another variant, the end wall 20 has an annular rib 45 surrounding the orifice 24, as can be seen in FIG. 5. When applicator element 10 comes in contact with the annular rib 45, the applicator element 10 may be spaced apart from the end wall 20 thus leaving an empty gap 46 relative thereto.

Figure 6:
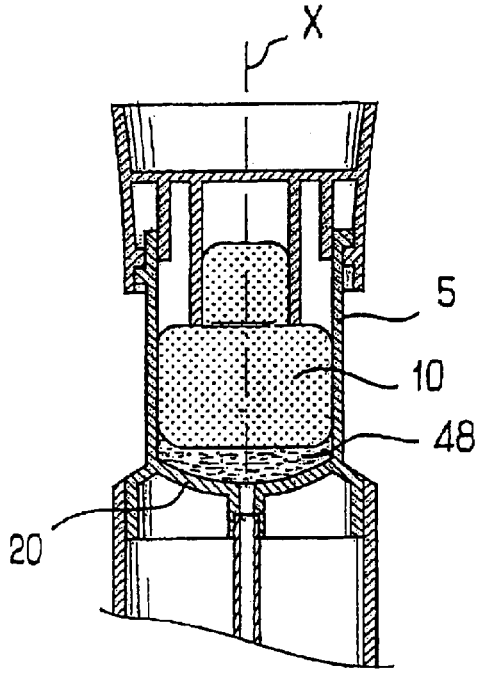

In yet another variant, a pad 48, shown in FIG. 6, is placed on the end wall 20. This pad may be made of a foam material and the applicator element 10 may come in contact with or come to bear against the pad as shown in FIG. 6. The pad 48 may serve as a reservoir for the product. This reservoir may serve not only to improve distribution of the product over the applicator element 10, but also to prevent any substantial leak of product when the applicator element 10 is withdrawn. In all the embodiments described above with reference to FIGS. 1 to 6, the applicator element may be removable.

Figure 7:
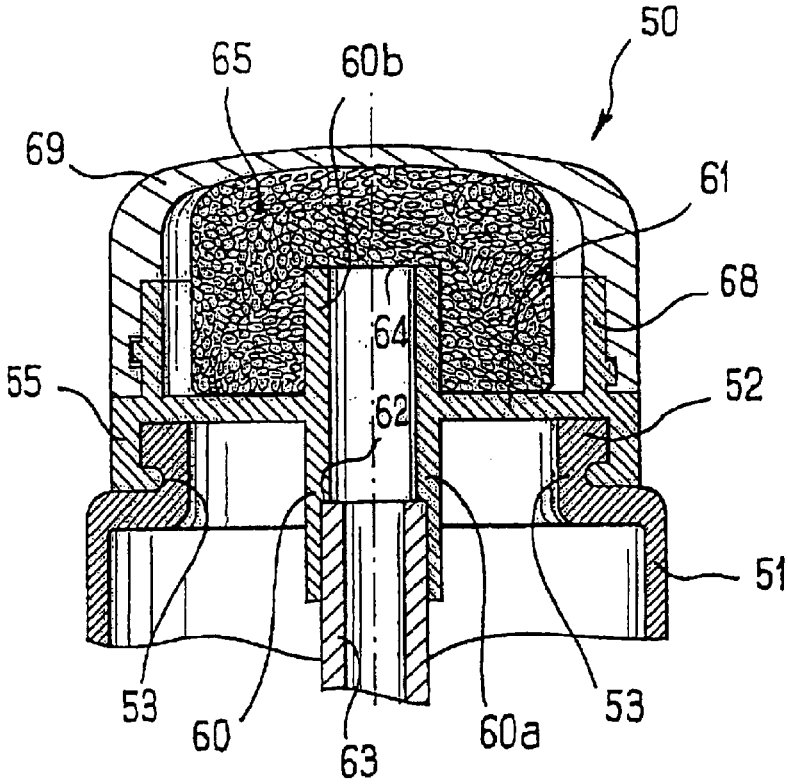
FIG. 7 is a fragmentary cross section view of a second exemplary embodiment.

It would not go beyond the ambit of the present invention, however, for the applicator element to remain secured to the receptacle. By way of example, FIG. 7 shows a device 50 comprising a receptacle 51 having a compressible wall 53 and provided at its top end with a neck 52 on which a support 55 is fixed b snap fastening.

The support 55 has an end wall 61 provided with a chimney 60 extending through the end wall. The bottom portion 60*a* of the chimney, situated beneath the end wall 61, has an inside shoulder 62 and may be used for fixing a dip tube 63. The top portion 60*b* of the chimney 60 situated above the end wall 61 has an outlet orifice 64.

The end wall 61 supports an applicator element 65 that is fixed to the end wall 61 by, for example, adhesive or heat-sealing. The applicator element 65 may be constituted by a sintered element, for example. The support 55 has an assembly skirt 68 provided with an outside thread suitable for co-operating with a complementary thread formed on the inside surface of a closure cap 69. The device 50 may be used by squeezing the receptacle 51 with the applicator element 65 on top, thereby feeding the applicator element 65 with product. Thereafter, squeezing of the receptacle 51 may be released. The receptacle may optionally be tilted during application, with the receptacle then serving as a handle.

Figure 8:
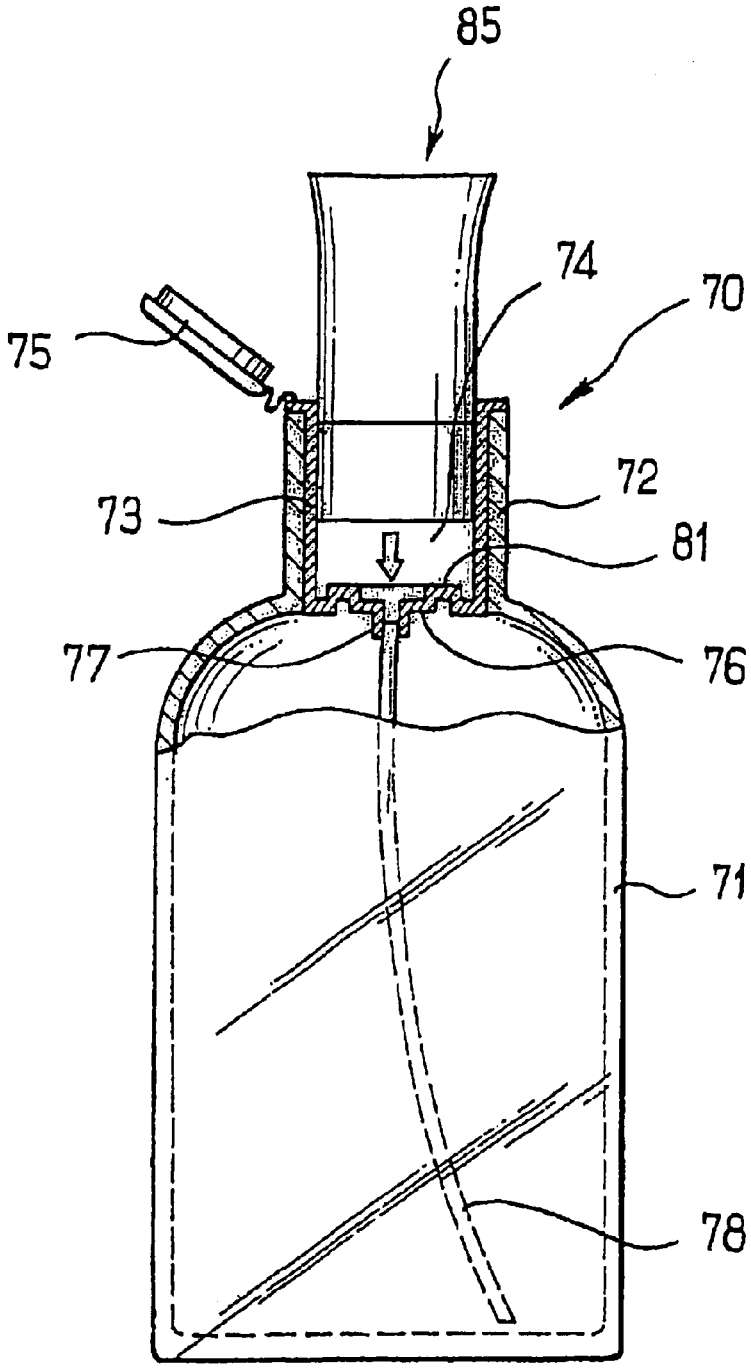
FIG. 8 is a fragmentary view, partially in cross section, showing a third exemplary embodiment.
Figure 9:
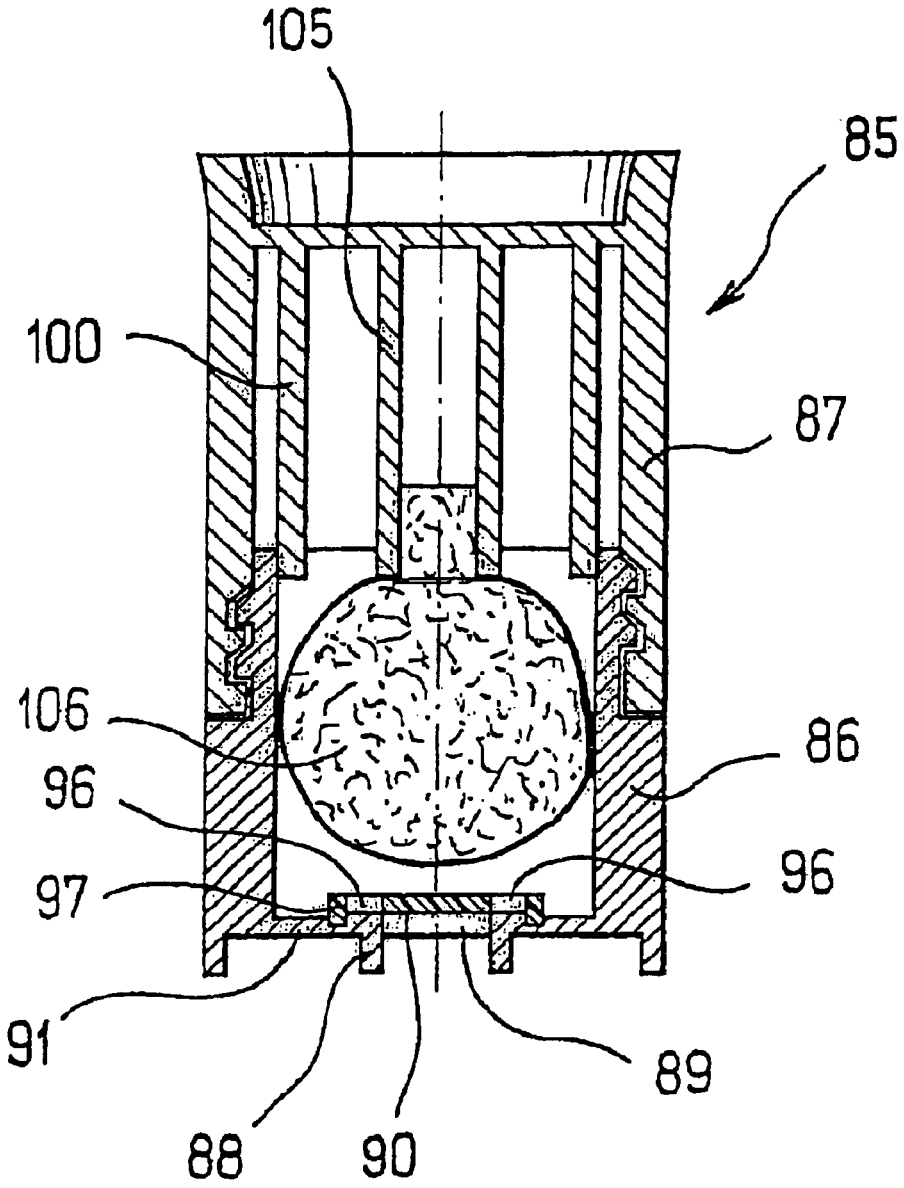
FIG. 9 is a cross section view of a removable unit of FIG. 8.

The applicator element according to any of the embodiments disclosed herein may form part of a removable unit, suitable for being refilled periodically by means of a receptacle provided with a neck and a dip tube like those described above. For example, at least one of a closure element (e.g., a handle) and a housing (e.g., a body) may define a removable unit (e.g., within which the applicator element may be received) configured to be associated with the receptacle to fill the unit with product. FIGS. 8 and 9 show such a removable unit 85. The unit is intended to be refilled by means of a receptacle 71 having a compressible wall, and having a neck 72 in which a portion 73 (e.g., insert, sleeve, third portion, etc.) is fixed to define a space suitable for removably receiving at least part of the removable unit 85 when it is to be refilled.

The insert 73 has a hinged lid 75 (e.g., second closure element) secured thereto for the purpose of closing the space 74 (e.g., portion, insert, etc.) when the removable unit 85 is absent (e.g., is not received by the portion). The end wall 76 of the insert 73 (e.g., sleeve) has an end-piece 77 for fixing a dip tube 78. An annular setback 81 is formed in the end wall 76.

The removable unit 85 comprises a bottom portion 86 defining a housing (e.g., body) for receiving at least a part of an applicator element 106 and a top portion 87 (e.g., closure element, handle, etc.) that are assembled (e.g., connected) together by screw fastening. The bottom portion 86 and the top portion 87 cooperate to define an inside space (e.g., an enclosure) in which the applicator element 106 may be contained. The removable unit 85 houses the applicator element 106 that may be fixed to one end of an assembly skirt 105 of the top portion 87. The applicator element 106 and the top portion 87 may constitute an applicator member that can be separated from the bottom portion 86, for example, at the time of application. The top portion 87 may then serve as a handle.

At least one of the top portion 87 (e.g., closure element, handle, second portion, etc.) and the bottom portion 86 (e.g., body, first portion, etc.) of the removable unit 85 has a sealing skirt 100 suitable for bearing in a substantially leak-proof manner against the bottom portion 86 when the removable unit is closed, as shown in FIG. 9. The bottom portion 86 has an end wall 91 pierced in its center by an orifice 89. An annular lip 88 extends downwards around the orifice 89 50 as to bear in a substantially leak-proof manner against the inside edge of the annular setback 81 of the end wall 76, thus enabling a substantially leak-proof communication between the end-piece 77 and the orifice 89.

A check valve 90 made of, for example, an elastomer material overmolded on the end wall 91 enables the orifice 89 to be substantially closed when, for example, the removable unit 85 is not being refilled. The check valve 90 comprises a central portion forming a shutter that is connected by bridges 96 of elastically deformable material to a peripheral portion 97 that is secured to the end wall 91.

To refill the removable unit 85, the unit may be put into place in the insert, or sleeve 73, until the sealing lip 88 comes to bear in a substantially leak-proof manner against the inside edge of the setback 81. Thereafter, the wall of the receptacle 71 may be squeezed, causing product to rise via the dip tube 78 with sufficient pressure to lift the check valve 90 off its seat.

Figure 10:
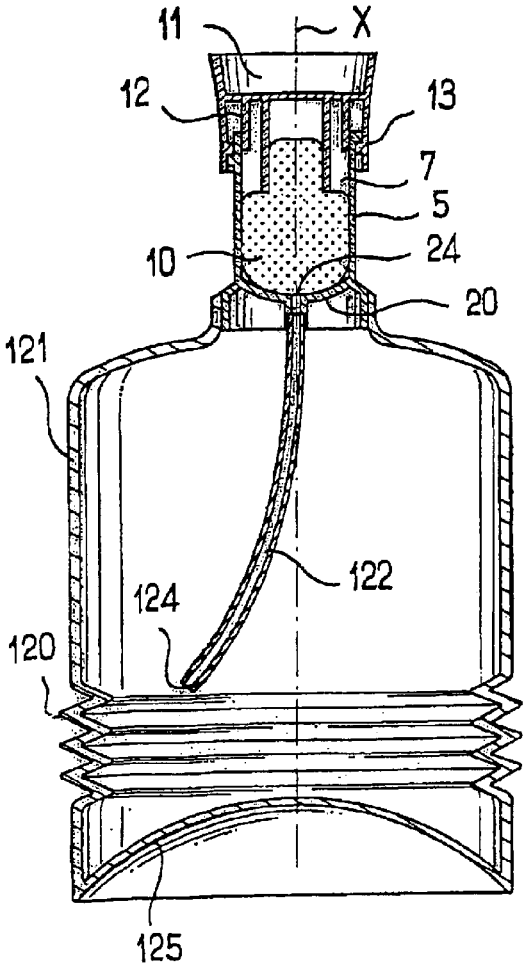
FIGS. 10 and 11 are cross section views of fourth and fifth exemplary embodiments, respectively.

Naturally, the invention is not limited to the embodiments described above. For example, the receptacle and the applicator element may be of different shapes. As shown in FIG. 10, the receptacle may include a bellows 120 about the axis X. When the top portion 121 of the receptacle is moved downwards, the inside volume of the receptacle may decrease and pressure may be generated.

A dip tube 122 may put the housing 7 into communication with the inside volume of the receptacle. The bottom end 124 of the tube may move towards the bottom end wall 125 of the receptacle when the bellows 120 is compressed. Once the bellows has been compressed, the end 124 may be located at the bottom 125 or may be sufficiently close thereto to ensure that substantially all of the product contained in the receptacle may be dispensed.

Figure 11:
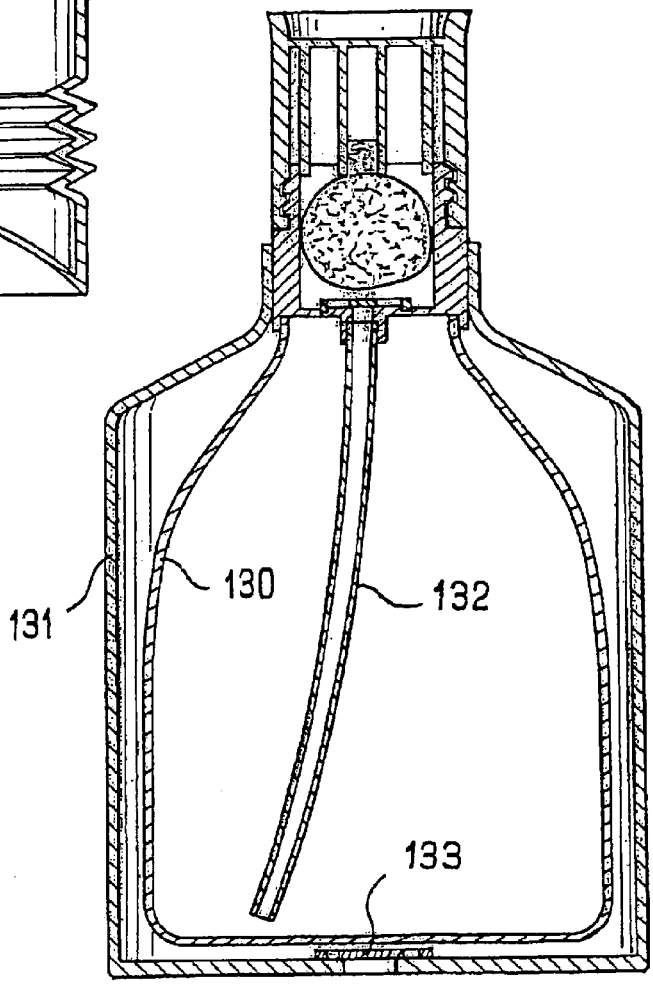

The product may also be contained in a flexible bag 130 placed inside a case 131, as shown in FIG. 11. The case 131 may be elastically deformable so as to enable a user to generate pressure around the bag 131. This pressure may serve to expel product via a dip tube 132. The case 131 has a check valve 133 that may be closed when the pressure inside the case is positive, but that may be suitable for opening when the pressure inside the case is negative. The decrease in the space occupied by the bag 130 as the product contained inside it is progressively expelled may thus be compensated by air penetrating into the case through the valve 133. The valve 133 may be overmolded on the case 131 as shown in FIG. 11.

Figure 12:
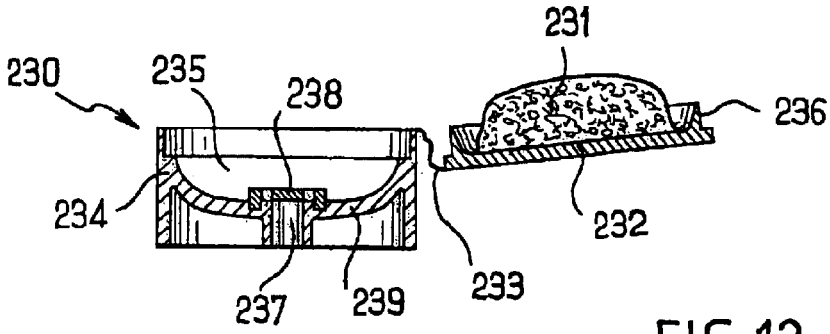
FIG. 12 is a cross section view showing an alternative embodiment of a removable unit.

FIG. 12 shows an example of a removable unit 230 having a feature whereby it includes an application element 231 that is carried by an element 232 connected via a film hinge 233 to a body 234 of the removable unit. The body 234 defines a cavity 235, for example, a generally concave cavity. The cavity 235 may be configured for receiving the element 231 when the lid 232 is in place on the body 234 to substantially close the cavity 235. By way of example, the lid 232 may include a sealing lip 236 suitable for pressing in a substantially leak-proof manner against the body 234. The wall 239 defining the bottom of the cavity 235 may define an orifice 237 that is suitable as a mating opening for mating with a portion of a receptacle. While the removable unit 230 is not being filled with product, the orifice 237 may be substantially closed, for example, by a check valve 238.

The removable unit 230 may be used in a similar manner as the removable unit described with reference to FIG. 8, or it may also be used with a receptacle as described below. The lid 232 may be opened so as to allow the element 231 to be brought into contact with a surface on which the product is to be applied.

Figure 13:
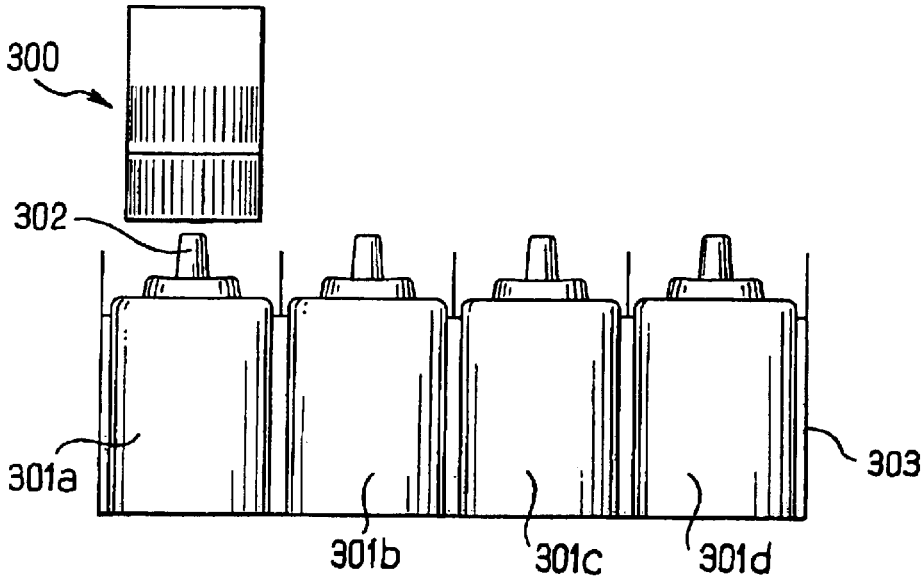
FIGS. 13 and 14 are perspective views of embodiments of an application system having a removable unit and a plurality of receptacles.
Figure 14:
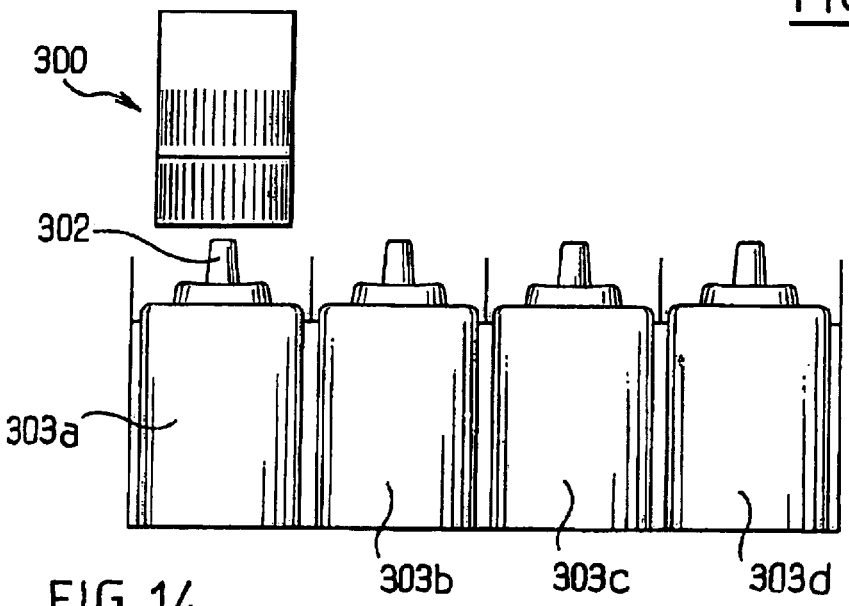

As shown in FIGS. 13 and 14, it also may be possible to use a removable unit 300, such as one of the units described above, not merely with a single receptacle, but with a plurality of receptacles 301*a*, 301*b*, 301*c*, 301*d* (in an example where there are four such receptacles). Each of the plurality of receptacles may be provided with a respective dispensing protrusion 302, for example, which is capable of being in flow communication with a respective receptacle dip tube (not shown).

The removable unit 300 may be suitable for cooperating temporarily with any one of these receptacles in order to transfer a certain quantity of a product from the receptacle into the applicator element contained within the removable unit.

Each of the receptacles 301*a*, 301*b*, 301*c*, and 301*d* may thus contain, for example, a different product. For example, each may contain a perfume that corresponds to a particular scent, and the user can select a receptacle as a function of the scent the user desires to wear on any particular day. By way of example, the receptacle 301*a* can contain a given perfume while the receptacles 301*b* to 301*d* can contain amber, woody, or floral varieties of the perfume, respectively.

The user also may fill the removable unit with a plurality of different products by connecting the removable unit temporarily to a plurality of receptacles in succession, depending on which products the user desires to transfer into the removable unit. The user may thus make up mixtures of scents, preparing a perfume "à la carte", as it were.

By way of example, the receptacles 301*a* to 301*d* can be contained in a single box 303, or they can be held on a common support, with the support being something other than a box.

The receptacles can contain products other than perfumes. For example, they can contain creams, lotions, or other products for applying to skin, hair, fingernails, toenails, or other surfaces. Such products could be cosmetic products and/or treatment products. For example, the product could be in liquid form, cream form, or foam form.

The removable unit 300 can be associated, for example, with a receptacle 303*a* containing sunscreen, a receptacle 303*b* containing vitamin C, a receptacle 303*c* containing vitamin A, and a receptacle 303*d* containing salicylic acid, and naturally the number of receptacles is not limited to four and could be greater or smaller.

It will be apparent to those skilled in the art that various modifications and variations can be made to the structure. Thus, it should be understood that the invention is not limited to the examples discussed in the specification. Rather, the present invention is intended to cover modifications and variations.

What is claimed is:

1. A product application device, comprising:

a receptacle having a variable inside volume configured to contain a product;

a cosmetic or care product contained in the receptacle;

an applicator element;

a housing for receiving at least part of the applicator element;

a closure element configured to close the housing in a substantially leak-proof manner when the applicator element is received at least partially in the housing; and a dip tube configured to extend substantially to the bottom of the receptacle, wherein the applicator element is removable from the housing, and wherein the dip tube is configured to enable the housing to be in flow communication with product flowing from the receptacle.

2. The device of claim 1, wherein the device is configured to allow a reduction in the variable inside volume of the receptacle from a first volume to a second volume smaller than the first volume, and wherein the reduction from the first volume to the second volume generates pressure inside the receptacle for causing the product to flow into the housing via the dip tube.

3. The device of claim 1, wherein the level of the product contained in the receptacle is selected so that, prior to first use, an end of the dip tube configured to extend substantially to the bottom of the receptacle lies above the level of the product when the receptacle is turned upside-down.

4. The device of claim 1, wherein the dip tube communicates with the housing at a bottom end of the housing.

5. The device of claim 1, wherein the housing comprises an end wall located at a bottom end of the housing.

6. The device of claim 5, wherein the end wall is substantially planar.

7. The device of claim 5, wherein the end wall is substantially concave towards a portion of the housing in which the applicator element is received.

8. The device of claim 1, wherein the dip tube is a separate element fixed to the housing.

9. The device of claim 5, wherein the dip tube is fixed to an end-piece integrally formed with the end wall.

10. The device of claim 5, wherein the dip tube is integrally formed with the end wall.

11. The device of claim 1, wherein the applicator element is fixed to the closure element.

12. The device of claim 11, wherein the closure element is configured to define a handle.

13. The device of claim 1, wherein the applicator element is fixed to the housing.

14. The device of claim 11, wherein the housing comprises an end wall, and wherein the applicator element is configured to contact the end wall of the housing when the applicator element is received in the housing.

15. The device of claim 1, wherein the housing comprises an end wall, and wherein the applicator element and the end wall of the housing define a gap therebetween when the applicator element is in place on the receptacle, the gap being configured to allow product to accumulate therein.

16. The device of claim 15, wherein at least a portion of the applicator element comprises a surface having a recess configured to face the end wall of the housing when the applicator element is received in the housing.

17. The device of claim 15, wherein the end wall comprises a recessed portion extending away from the applicator element when the applicator element is received in the housing.

18. The device of claim 15, wherein the end wall includes an annular rim configured to contact the applicator element when the applicator element is received in the housing.

19. The device of claim 5, wherein the housing further comprises an intermediate wall situated between the applicator element and the end wall when the applicator element is received in the housing.

20. The device of claim 5, further comprising a porous pad located on the end wall of the housing and configured to contact the applicator element when the applicator element is received in the housing.

21. The device of claim 20, wherein the porous pad comprises foam material.

22. The device of claim 1, wherein the applicator element is compressible.

23. The device of claim 1, wherein the applicator element is not compressible.

24. The device of claim 22, wherein the applicator element comprises a foam formed of a plastic material.

25. The device of claim 24, wherein the plastic material is chosen from polyurethane, polyester, polyether, PVC, and NBR.

26. The device of claim 23, wherein the applicator element comprises a sintered material.

27. The device of claim 26, wherein the sintered material is chosen from polyethylene, PVC, EVA, polyamide, and brass.

28. The device of claim 1, wherein the applicator element comprises felt.

29. The device of claim 1, wherein the product contained in the receptacle comprises a cosmetic product.

30. The device of claim 29, wherein the cosmetic product is perfume.

31. The device of claim 1, wherein the receptacle comprises a flexible-walled receptacle.

32. The device of claim 1, wherein the receptacle further comprises a bellows.

33. The device of claim 1, wherein the receptacle comprises a case having a bag therein, wherein the case is configured to cause an increase in pressure in the bag.

34. The device of claim 33, wherein the case is provided with a check valve configured to allow air to be drawn into the case after a quantity of product has been expelled from the bag.

35. The device of claim 32, wherein the dip tube is secured to a portion of the receptacle situated above the bellows.

36. The device of claim 1, wherein the device is configured so that the device is capable of moving from a first configuration wherein the dip tube does not extend substantially to the bottom of the receptacle to a second configuration wherein the dip tube extends substantially to the bottom of the receptacle.

37. The device of claim 1, wherein the housing comprises an open end and wherein the closure is configured to close the open end.

38. The device of claim 1, wherein the closure element and the housing each comprise screw threading configured to enable removable coupling of the closure element and the housing.

39. A product application device for a cosmetic or care product, comprising:

a receptacle having a variable inside volume configured to contain a product;

an applicator element;

a housing for receiving at least part of the applicator element;

a closure element configured to close the housing in a substantially leak-proof manner when the applicator element is received at least partially in the housing; and a dip tube configured to extend substantially to the bottom of the receptacle, wherein the dip tube is configured to enable the housing to be in flow communication with product flowing from the receptacle, wherein at least one of the closure element and the housing defines a removable unit configured to be associated with the receptacle to fill the unit with the product, and wherein the a applicator element is received within the removable unit.

40. The device of claim 39, wherein the housing defines a body and the closure element defines a handle, the body and the handle cooperating to define an inside space in which the applicator element is contained.

41. The device of claim 40, wherein the inside space is substantially leak-proof.

42. The device of claim 40, wherein the handle and the body are connected by screw fastening.

43. The device of claim 40, wherein at least one of the handle and the body of the removable unit comprises a sealing skirt.

44. The device of claim 40, wherein the removable unit comprises a check valve configured to allow product under pressure to pass to the inside space of the removable unit.

45. The device of claim 39, further comprising a portion configured to removably receive at least part of the removable unit, wherein the portion is located on the receptacle.

46. The device of claim 45, further comprising a second closure element for closing the portion when the removable unit is not received by the portion.

47. The device of claim 45, wherein the portion is configured to be in flow communication with the variable inside volume via the dip tube.

48. The device of claim 45, wherein the portion comprises a sleeve having an open end through which said at least a part of the removable unit passes and another end placed in flow communication with the variable inside volume via the dip tube.

49. A product application device, comprising:

a receptacle having a variable inside volume configured to contain a product;

a cosmetic or care product contained in the receptacle;

an applicator element;

a first portion and a second portion configured to cooperate together to define a substantially leak-proof enclosure for the applicator element; and a dip tube configured to extend to the bottom of the receptacle, wherein the applicator element is removable from the housing, and wherein the dip tube is configured to enable the enclosure to be in flow communication with product flowing from the receptacle.

50. The device of claim 49, wherein the first portion comprises a housing for receiving at least part of the applicator element, and the second portion comprises a closure element configured to close the housing.

51. The device of claim 49, wherein the device is configured to allow a reduction in the variable inside volume of the receptacle from a first volume to a second volume smaller than the first volume, and wherein the reduction from the first volume to the second volume generates pressure inside the receptacle for causing the product to flow into the enclosure via the dip tube.

52. The device of claim 49, wherein the level of the product contained in the receptacle is selected so that, prior to first use, an end of the dip tube configured to extend substantially to the bottom of the receptacle lies above the level of product when the receptacle is turned upside-down.

53. The device of claim 49, wherein the dip tube communicates with the enclosure at a bottom end of the enclosure.

54. The device of claim 49, wherein one of the first portion and the second portion comprises an end wall located at a bottom end of the enclosure.

55. The device of claim 54, wherein the end wall is substantially planar.

56. The device of claim 50, wherein the closure element is configured to define a handle.

57. The device of claim 50, wherein the applicator element is fixed to the housing.

58. The device of claim 49, wherein the first and second portions are connected by screw fastening.

59. The device of claim 49, wherein the first and second portions are connected by snap fastening.

60. The device of claim 49, wherein the first and second portions are connected by a hinge.

61. The device of claim 49, wherein at least one of the first portion and second portion comprises a sealing skirt.

62. The device of claim 49, wherein one of the first portion and the second portion comprises a check valve configured to allow product under pressure to pass to the inside space of the enclosure.

63. The device of claim 49, wherein the product contained in the receptacle comprises a cosmetic product.

64. The device of claim 63, wherein the cosmetic product is perfume.

65. The device of claim 49, wherein the receptacle comprises a flexible-walled receptacle.

66. The device of claim 49, wherein the receptacle further comprises a bellows.

67. The device of claim 49, wherein the receptacle comprises a case having a bag therein, wherein the case is configured to cause an increase in pressure in the bag.

68. The device of claim 67, wherein the case is provided with a check valve configured to allow air to be drawn into the case after a quantity of product has been expelled from the bag.

69. The device of claim 66, wherein the dip tube is secured to a portion of the receptacle situated above the bellows.

70. The device of claim 49, wherein the device is configured so that the device is capable of moving from a first configuration wherein the dip tube does not extend substantially to the bottom of the receptacle to a second configuration wherein the dip tube extends substantially to the bottom of the receptacle.

71. The device of claim 49, wherein the applicator element is fixed to one of the first portion and the second portion.

72. The device of claim 71, wherein the applicator element is fixed to the second portion and the second portion defines a handle.

73. The device of claim 71, wherein the applicator element is fixed to the first portion and the first portion is fixed to the receptacle.

74. A product application system, comprising:

the device of claim 49, and at least one additional receptacle comprising a variable inside volume configured to contain product and a dip tube configured to extend to the bottom of the additional receptacle, wherein the dip tube of the at least one additional receptacle is configured to enable the enclosure to be in flow communication with product flowing from the at least one additional receptacle.

75. The system of claim 74, comprising a product in the additional receptacle, wherein each of the receptacles contains a differing product.

76. A product application device, comprising:

a receptacle having a variable inside volume configured to contain a product;

an applicator element;

a first portion and a second portion configured to cooperate together to define a substantially leak-proof enclosure for the applicator element; and a dip tube configured to extend to the bottom of the receptacle, wherein the dip tube is configured to enable the enclosure to be in flow communication with product flowing from the receptacle, and wherein the first and second portions cooperate to define a removable unit.

77. The device of claim 76, further comprising a third portion located on the receptacle, wherein the removable unit is configured to be removably associated with the third portion.

78. The device of claim 77, wherein the dip tube is connected to the third portion.

79. The device of claim 77, further comprising a closure element for closing the third portion when the removable unit is not associated with the third portion.

80. The device of claim 77, wherein the third portion is configured to be in flow communication with the variable inside volume via the dip tube.

81. The device of claim 77, wherein the third portion comprises a sleeve having an open end through which at least a part of the removable unit passes and another end placed in flow communication with the variable inside volume via the dip tube.

82. The device of claim 77, wherein the third portion comprises a protrusion for mating with a mating opening located at an end of the removable unit.

83. A product application device, comprising:

a receptacle having a variable inside volume configured to contain a cosmetic or care product;

a cosmetic or care product contained in the receptacle;

an applicator element;

a housing for receiving at least part of the applicator element, wherein the housing comprises an opening through which said at least part of the applicator element passes;

a closure element configured to close the opening of the housing in a substantially leak-proof manner when the applicator element is received at least partially in the housing; and a dip tube configured to extend substantially to the bottom of the receptacle, wherein the device is configured to enable the housing to be in flow communication with the product contained in the receptacle when the opening of the housing is closed by the closure element.

84. The device of claim 83, wherein the device is configured to allow a reduction in the variable inside volume of the receptacle from a first volume to a second volume smaller than the first volume, and wherein the reduction from the first volume to the second volume generates pressure inside the receptacle for causing the product to flow into the housing via the dip tube.

85. The device of claim 83, wherein the level of the product contained in the receptacle is selected so that, prior to first use, an end of the dip tube configured to extend substantially to the bottom of the receptacle lies above the level of the product when the receptacle is turned upside-down.

86. The device of claim 83, wherein the dip tube communicates with the housing at a bottom end of the housing.

87. The device of claim 83, wherein the housing comprises an end wall located at a bottom end of the housing.

88. The device of claim 87, wherein the dip tube is fixed to an end-piece integrally formed with the end wall.

89. The device of claim 87, wherein the dip tube is integrally formed with the end wall.

90. The device of claim 83, wherein the applicator element is removable from the housing.

91. The device of claim 83, wherein the applicator element is fixed to the closure element.

92. The device of claim 91, wherein the closure element is configured to define a handle.

93. The device of claim 91, wherein the housing comprises an end wall, and wherein the applicator element is configured to contact the end wall of the housing when the applicator element is received in the housing.

94. The device of claim 83, wherein the applicator element is fixed to the housing.

95. The device of claim 83, wherein the housing comprises an end wall, and wherein the applicator element and the end wall of the housing define a gap therebetween when the applicator element is in place on the receptacle, the gap being configured to allow product to accumulate therein.

96. The device of claim 95, wherein at least a portion of the applicator element comprises a surface having a recess configured to face the end wall of the housing when the applicator element is received in the housing.

97. The device of claim 95, wherein the end wall comprises a recessed portion extending away from the applicator element when the applicator element is received in the housing.

98. The device of claim 87, wherein the housing further comprises an intermediate wall situated between the applicator element and the end wall when the applicator element is received in the housing.

99. The device of claim 83, wherein at least one of the closure element and the housing defines a removable unit configured to be associated with the receptacle to fill the unit with the product, and wherein the applicator element is received within the removable unit.

100. The device of claim 99, wherein the housing defines a body and the closure element defines a handle, the body and the handle cooperating to define an inside space in which the applicator element is contained.

101. The device of claim 100, wherein the removable unit comprises a check valve configured to allow product under pressure to pass to the inside space of the removable unit.

102. The device of claim 99, further comprising a portion configured to removably receive at least part of the removable unit, wherein the portion is located on the receptacle.

103. The device of claim 102, further comprising a second closure element for closing the portion when the removable unit is not received by the portion.

104. The device of claim 102, wherein the portion is configured to be in flow communication with the variable inside volume via the dip tube.

105. The device of claim 83, wherein the receptacle comprises a flexible-walled receptacle.

106. The device of claim 83, wherein the receptacle further comprises a bellows.

107. The device of claim 83, wherein the receptacle comprises a case having a bag therein, wherein the case is configured to cause an increase in pressure in the bag.

* * * * *